United States Patent [19]

Carrier

[11] Patent Number: 4,512,089

[45] Date of Patent: Apr. 23, 1985

[54] WINTER BOOT

[76] Inventor: Anthony Carrier, 25 Edmunds Dr., Toronto, Ontario, Canada, M4N 2P7

[21] Appl. No.: 610,923

[22] Filed: May 14, 1984

Related U.S. Application Data

[63] Continuation of Ser. No. 415,535, Sep. 7, 1982, abandoned.

[51] Int. Cl.[3] ..... A43B 3/30

[52] U.S. Cl. ..... 36/112; 36/4; 36/50; 2/DIG. 6

[58] Field of Search ..... 36/50, 4, 112, 7.1, 36/7.3; 2/DIG. 6

[56] References Cited

U.S. PATENT DOCUMENTS

| | | | |
|---|---|---|---|
| 799,685 | 9/1905 | Stearns | 36/4 |
| 2,398,510 | 4/1946 | Wilson | 36/112 X |
| 2,933,831 | 4/1960 | Compte | 36/4 |
| 3,845,769 | 11/1974 | Shaw | 36/50 X |

FOREIGN PATENT DOCUMENTS

| | | | |
|---|---|---|---|
| 472062 | 7/1914 | France | 36/50 |
| 1456085 | 9/1966 | France | 2/DIG. 6 |

OTHER PUBLICATIONS

"Velcro Product News", Velcro U.S.A. Inc., May 1978, PN No. 45.

"Cleveland Housewife Saw Need for Special Clothes", Press-Citizen, Iowa City, PNR #1115, Dec. 18, 1967.

*Primary Examiner*—Werner H. Schroeder
*Assistant Examiner*—Tracy Graveline
*Attorney, Agent, or Firm*—Fetherstonhaugh & Co.

[57] ABSTRACT

The invention is a boot with a foot portion and a leg portion of flexible repellant material, said leg portion comprising an elongate V-shaped gusset in the flexible leg portion with its upper edge at the upper edge of the flexible leg portion, an elongated flap coextensive with one side of the gusset, a first elongated strip of adhesive material on the inner side of said flap, a second elongated strip of adhesive material at the other side of said gusset and coextensive therewith, said first and said second elongated strips of adhesive material being adapted to unite one to the other when pressed into contact with each other, said elongated strips of adhesive material having a width whereby they can be adhered together with variable overlap to fold said gusset varying amounts to vary the closed circumference of said leg portion to achieve a snug fit around the leg of a user in use and exclude snow and moisture.

2 Claims, 4 Drawing Figures

WINTER BOOT

This application is a continuation of application Ser. No. 415,535 filed Sept. 7, 1982, now abandoned.

This invention relates to a boot that has a waterproof foot portion which encloses the foot of the user up to the vicinity of the ankle, and a flexible leg portion extending upwardly therefrom wherein the leg portion is continuous around the boot and can be wrapped tightly around the lower portion of the leg of a wearer.

Boots of this nature are commonly worn by children and the principal purpose of the wrap-around leg portion is to exclude snow and water from entering the boot. The upper must be made oversize to permit easy insertion of the foot and must have a means for folding its excess width and securing it in wrap-around relation on the leg to prevent entry of snow and the like in use. While these boots are popular with children because children often find themselves out of door under conditions of heavy snow, they are also used extensively by adults as a snow boot.

Boots with uppers and securing means for the uppers capable of achieving these objectives broadly are common. This invention is primarily concerned with a means for securing the flexible upper in wrap-around relation. Generally speaking, adults do not have a great deal of difficulty in securing the upper in wrap-around relation with the presently available means for securing the uppers, notwithstanding the fact that many of the securement means are not as convenient as they might be. Children, on the other hand, and especially children of about the age of three tend to have difficulty in securing the upper in wrap-around relation. It has been observed that the commonly used securing means cannot be manipulated with reliability by the average child of about three years of age.

The securing means of the prior art include buckles and/or straps that tie a folded over section of the flexible upper to the main section of the flexible upper whereby to achieve the necessary tight fit around the leg to exclude snow. Buckles are too complex for a small child to operate and are also inconvenient to an older reason. Straps can be secured with buckles or with a hook and loop adhesive material. The fabric hook and loop type adhesive fastener overcomes the objection to buckles for an adult but a small child has difficulty in reliably closing a velcro type strap securement. He does not, generally speaking, have the alignment skills necessary to reliably tighten the boot.

Moreover, a buckle and/or a strap securement means for these boots often leaves something to be desired from a weatherproof point of view. Snow and/or water can penetrate under the folded over portion of the leg and result in discomfort.

It is an object of this invention to provide a snow boot design having a flexible wrap-around leg portion that can be simply and positively closed even by a three year old user.

It is a further object of this invention to provide a snow boot design having a flexible wrap-around leg portion that forms an effective exclusion to snow and water.

It is a further object of the invention to provide a snow boot design having a flexible wrap-around leg portion that is economic to manufacture.

With these and other objects in view, a boot according to this invention has a foot portion and a leg portion of flexible water repellant material, said leg portion comprising:

an elongate V-shaped gusset in the flexible leg portion with its upper edge at the upper edge of the flexible leg portion;

an elongated flap coextensive with one side of the gusset;

a first elongated strip of adhesive material on the inner side of said flap;

a second elongated strip of adhesive material at the other side of said gusset and coextensive therewith;

said first and said second elongated strips of adhesive material being adapted to unite one to the other when pressed into contact with each other;

said elongated strips of adhesive material having a width whereby they can be adhered together with variable overlap to fold said gusset varying amounts to vary the closed circumference of said leg portion to achieve a tight fit around the leg of a user in use an exclude snow and moisture.

The invention will be clearly understood after reading the following detailed description read in conjunction with the drawings.

Figure 2:
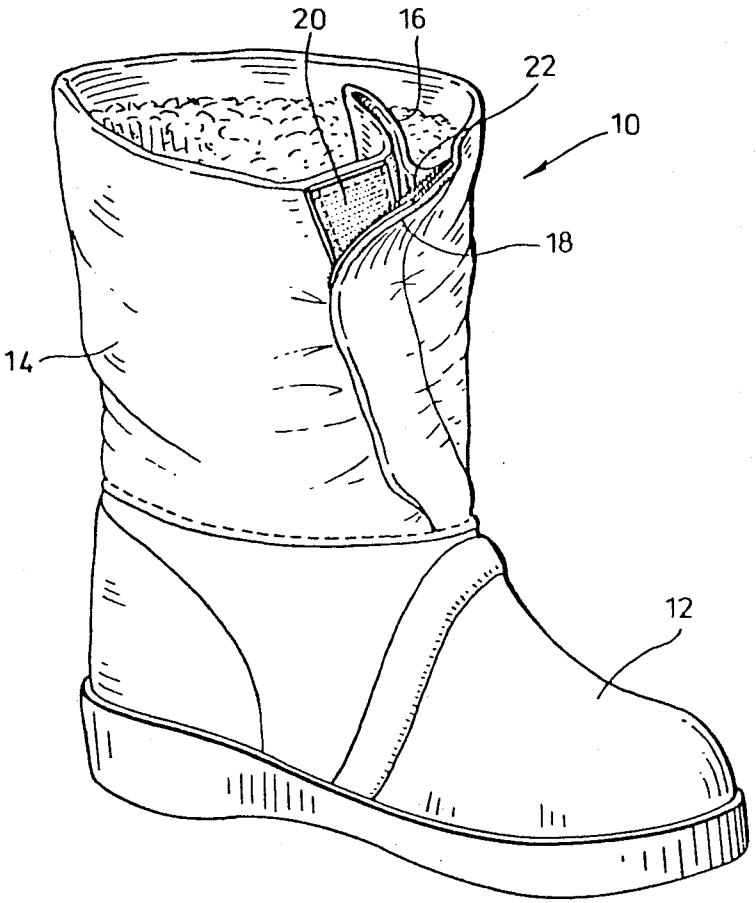
FIG. 2 is an illustration of the same boot with the gusset folded and the elongated adhesive strips adhered with substantial overlap to make a relatively wide closed circumference of the leg portion.

Referring to the drawings, the numeral 10 generally refers to a boot that has a foot portion 12 and a leg portion 14 of a flexible water repellant material such as nylon, the leg portion having first and second upright elongated side edges which extend continuously from the top of the foot portion, to the top of the leg portion. The foot portion is normally made of rubber or a plastics equivalent thereof and the flexible leg portion is often fleece lined. The leg portion is continuous from its bottom to its upper edge and has an elongated V-shaped gusset 16 at its front. Gusset 16 is joined into the upper along each of its elongated side edges which extend continuously from the top of the foot portion to the top of the leg portion.

An elongated flap 18 extends along a second side edge of the gusset 16 and an elongated first strip of adhesive material 20 extends along the marginal portion of the first side of the gusset 16. The inner side of the flap 18 has an elongated second strip of adhesive material 22 secured thereto, both strips extending continuously from the top of the foot portion to the top of the leg portion.

The adhesive material that thus extends along the side edges of the V-shaped gusset is preferably a hook-and-loop type of adhesive such as VELCRO (Trade Mark of VELCRO U.S.A. Inc.). VELCRO fastenings comprise two sheets, one of which has a series of loops and the other of which has a series of hooks. When the two sheets are pressed together they adhere and form a fastening. They can be, with pressure, torn apart. These types of fastening are well known in the clothing and other businesses.

While the invention discloses a hook and loop type of fastener, other pressure sensitive fastening devices for the fastening strips 20 and 22 are contemplated.

Figure 1:
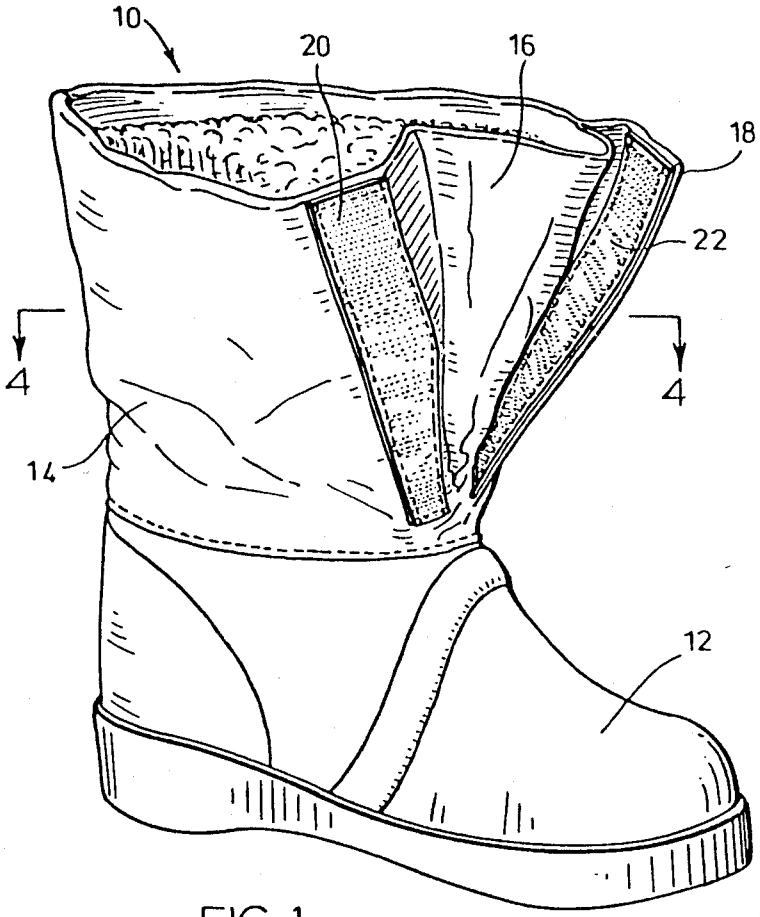
FIG. 1 is an illustration of a boot according to this invention with the V-shaped gusset and elongated flap in the open position.

The user slips his foot into the boot when it is in the position of FIG. 1 with the gusset open and the adhesive strips-unsecured. If the user has little other bulk around his lower leg he will want to provide for substantial wrap-around and he will take the flap 18 and draw it around to wrap the gusset portion around his leg and apply the strip 22 to the strip 20 to secure the boot in a closed position as illustrated in FIG. 2. In FIG. 2 the upper portion of the flap 18 has been illustrated as turned over to indicate the amount of overlap of the adhesive strips 20 and 22. The overlap is relatively substantial and a relatively large overlap is achieved.

Figure 3:
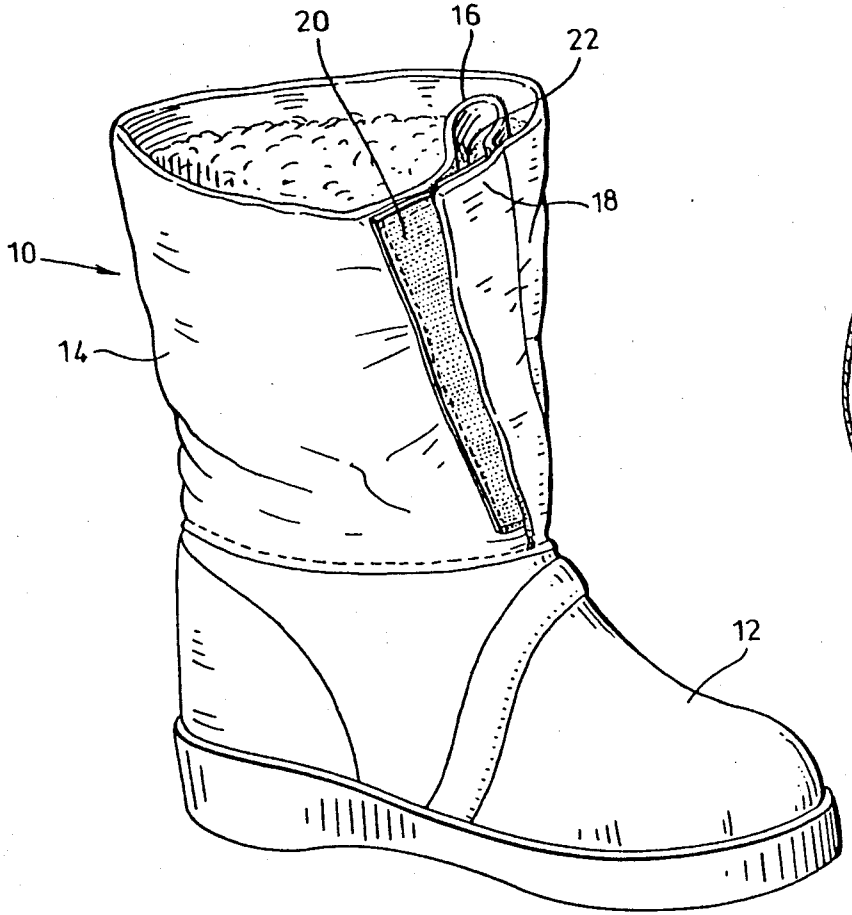
FIG. 3 is an illustration of the boot with the elongated strips of adhesive material adhered together with less overlap whereby to fold the gusset a lesser amount than in FIG. 2 to provide a relatively wide closed circumference of the leg portion.

In FIG. 3 the elongated flap 18 has been illustrated with less overlap to provide a larger circumference. This position would be used where, for example, the user wanted to fold the lower end of a long trouser into the boot. The user in each case, however, would achieve the amount of overlap and wrap-around to obtain a tight fit of the upper around the leg.

The simplicity with which the upper can be wrapped around the leg without any requirement for alignment of straps or securing means will be apparent. The user merely has to take the free flap 18 and draw it around the leg. By so doing the elongated strips of adhesive material will automatically come into contact with each other as the closure is made around the leg. It will also be apparent that the seal is an effective one and extends from top to bottom of the gusset. There is no possibility of snow or moisture lodging itself in the folds of the gusset during use.

While the closure is one that can be effected by the youngest wearer of this type of boot without help it is also a positive and effective one that will command itself to a user of this type of boot of any age. It is both easier to use and highly effective.

It will also be apparent that the construction is relatively inexpensive to manufacture since it has no buckles to apply or straps to align.

Figure 4:
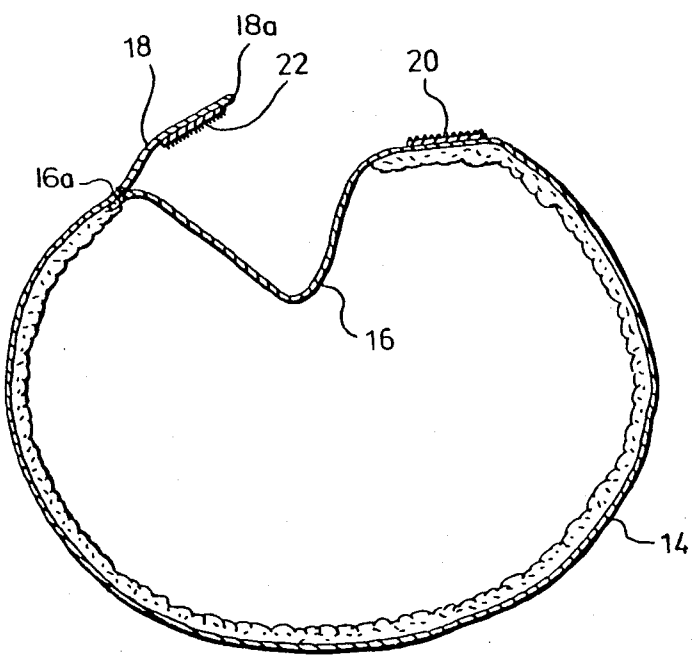
FIG. 4 is an illustration along the line 4—4 showing the construction of the gusset.

FIG. 4 is a cross-section of the upper portion of the boot illustrating the manner in which the gusset is stitched into the boot forming an upright seam 16*a*. The gusset is preferably made from a nylon material, and the seam 16*a* is spaced inwardly from the second edge 18*a* of the leg portion by a distance which is at least as great as the width of the second adhesive strip 22.

Embodiments of the invention other than the one illustrated in the art will be apparent to those skilled in the art and it is not intended that the foregoing description should be read in a limiting sense.

The embodiments of the invention in which an exclusive property or privilege is claimed are defined as follows:

1. A boot having a waterproof foot portion enclosing the foot of the user and having a leg portion fixed to the top of the foot portion and extending therefrom up the leg of the user, the leg portion comprising:

(a) a water repellant flexible material shaped to surround the leg of the user and having opposed first and second upright edges at first and second sides of the leg portion, which edges extend continuously from the top of the foot portion to the top of the leg portion;

(b) first and second elongated strips of adhesive material operative to adhere to one-another when pressed into mutual contact, the first and second strips being of substantial width and being attached in mutually opposed relationship at said first and second upright edges and both extending continuously therealong from the top of the foot portion to the top of the (c) a V-shaped gusset joined to said first side of the leg portion at said first upright edge and extending beyond the first adhesive strip toward the second side of the leg portion and being joined thereto inside the leg portion along an upright seam which is spaced inwardly of said second side from said second upright edge by a distance which is at least as great as the width of said second adhesive strip, the seam extending from the top of the foot portion to the top of the leg portion and defining between it and the second edge an elongated flap which is coextensive with said second edge and which supports said second adhesive strip; and (d) the gusset being folded over upon itself against the leg of the user and the second adhesive strip inside the flap being overlapped and adhered to the first adhesive strip at the first edge of the leg portion, the overlap being variable to vary the closed circumference of the portion to achive a tight fit around the leg of the user.

2. A boot having a foot portion and a leg portion of flexible water repellant material as claimed in claim 1 wherein one of said elongated strips of adhesive material is of a loop material and the other of said strips of elongated adhesive material is of a hook material adapted to adhere to the looped material upon the application of pressure.

* * * * *